US007306314B2

(12) United States Patent
Uemura

(10) Patent No.: US 7,306,314 B2
(45) Date of Patent: Dec. 11, 2007

(54) RECORDING APPARATUS AND RECORDING CONTROL METHOD

(75) Inventor: Hiroshi Uemura, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 38 days.

(21) Appl. No.: 11/425,661

(22) Filed: Jun. 21, 2006

(65) Prior Publication Data

US 2006/0290727 A1 Dec. 28, 2006

(30) Foreign Application Priority Data

Jun. 28, 2005 (JP) ..... 2005-188291

(51) Int. Cl.
*B41J 29/393* (2006.01)

(52) U.S. Cl. ..... 347/19; 347/41

(58) Field of Classification Search ..... 347/19, 347/41, 11, 15, 5, 7, 9
See application file for complete search history.

(56) References Cited

U.S. PATENT DOCUMENTS 6,412,903 B1 * 7/2002 Lee et al. ..... 347/19
6,554,398 B2 * 4/2003 Wyngaert et al. ..... 347/42
6,637,854 B2 * 10/2003 Serra et al. ..... 347/19
2003/0058295 A1 * 3/2003 Heiles et al. ..... 347/19

FOREIGN PATENT DOCUMENTS

JP 07-137240 A 5/1995
JP 11-042803 A 2/1999

* cited by examiner

*Primary Examiner*—Lamson Nguyen
(74) *Attorney, Agent, or Firm*—Canon USA Inc IP Division

(57) ABSTRACT

A recording apparatus performs recording with a recording head having a number of recording elements divided into blocks. The recording apparatus includes a signal generation unit to generate first enabling signals based on inclination information associated with each of the blocks of the recording elements. The first enabling signals are used to enable a data generating unit to generate recording data on a block-by-block basis. The signal generation unit further generates second enabling signals that correspond to the respective first enabling signals delayed by a time interval and enable the recording elements to be driven on a block-by-block basis.

19 Claims, 11 Drawing Sheets

RECORDING APPARATUS AND RECORDING CONTROL METHOD

BACKGROUND OF THE INVENTION

1. Field of the Invention

The present invention relates to control of image recording using a recording head and particularly to recording control according to inclination (misalignment) of a recording head or nozzle rows (nozzle array) of a recording head.

2. Description of the Related Art

A serial scanning type recording apparatus performs recording by using a recording head (print head) having element rows (also referred to hereinafter as "nozzle rows" and/or "nozzle array"), each containing recording elements (e.g., nozzles from which ink is discharged) arranged in a direction orthogonal to a main scanning direction. The recording apparatus performs printing while scanning a recording medium with the recording head, and transports the recording medium in a sub-scanning direction (which is orthogonal to the main scanning direction). The recording apparatus thus repeats the scanning and transporting process, thereby forming an image on the recording medium.

A typical print head is secured to a carriage holder (hereinafter called "carriage"). Since the print head is positioned such that nozzle rows (nozzle array) thereof are orthogonal to the main scanning direction, dots can be accurately arranged on a recording medium when ink is ejected during the scanning of the recording medium. However, due to manufacturing tolerances and assembly errors, nozzle rows (nozzle array) of the print head are, in fact, often not orthogonal to the main scanning direction. Moreover, the amount of inclination of nozzle rows (nozzle array) caused by assembly errors of the print head may not be consistent and may change every time the user attaches the print head to the recording apparatus.

The inclination of nozzle rows (nozzle array) causes misalignment of lines and colors on a printed image and leads to degraded image quality. Since recent tendencies toward longer and greater number of nozzle rows (nozzle array) and higher resolution cause more noticeable misalignment of lines and colors, a need exists to develop mechanisms for correcting the inclination of nozzle rows (nozzle array).

There is a proposed recording apparatus in which a plurality of heating dots are divided into a predetermined number of heating dot groups according to the amount of inclination of a print head, and print timing is shifted at each heating dot group so as to correct the inclination of the print head. If the amount of head inclination "D" is in the range of [N dots$<D\leqq$(N+1) dots] on a print dot basis, a plurality of heating dots are divided into (N+1) heating dot groups. Then, from the first heating dot group at which to start printing, print timing is shifted by one dot at each heating dot group to perform printing.

This print timing is divided into a plurality of segments (blocks) within a period of a pulse signal corresponding to one column (one pixel).

In this recording apparatus, print data that is shifted in a print direction on a dot-by-dot basis is expanded (stored) in an image buffer. Then, after the addition of off-dot data to be used for correction, print timing is shifted to correct the inclination of the print head.

Such a recording apparatus is discussed, for example, in Japanese Patent Laid-Open No. 11-42803 and Japanese Patent Laid-Open No. 7-137240.

However, in the known techniques described above, data that is shifted on a dot-by-dot basis has to be stored in the image buffer. Therefore, if the amount of data increases due to the increased length of a print head or the increased number of nozzle rows (nozzle array) for multiple ink colors, a problem arises in that a heavier load is placed on control for data processing.

Moreover, in timing control discussed in Japanese Patent Laid-Open No. 7-137240, timing adjustment through split driving can be performed only within the range (timing) of one pixel and cannot be performed over the range of one pixel.

SUMMARY OF THE INVENTION

Embodiments of the present invention have been made in view of the problems described above and are directed to correcting dot misalignment caused by the inclination of a print head without performing data correction in a print buffer.

According to an aspect of the present invention, a recording apparatus performs recording with a recording head having at least one recording element row containing a plurality of recording elements arranged in a direction differing from a main scanning direction. The recording elements of the recording element row are divided into a plurality of blocks. The recording apparatus includes a position signal generating unit configured to generate a recording position signal with respect to the main scanning direction, a data generating unit configured to generate recording data, and an enabling signal generating unit configured to generate a plurality of first enabling signals based on information about inclination of the recording element row and the recording position signal generated by the position signal generating unit. The first enabling signals are used to enable the data generating unit to generate recording data on a block-by-block basis in the main scanning direction. The enabling signal generating unit is further configured to generate a plurality of second enabling signals that correspond to the respective first enabling signals delayed by a time interval. The second enabling signals are used to enable the recording elements to be driven on a block-by-block basis. The recording apparatus further includes a drive unit configured to drive the recording elements on a block-by-block basis according to the second enabling signals.

According to another aspect of the present invention, a printing apparatus performs printing with a print head having at least one nozzle row containing a plurality of nozzles arranged in a direction differing from a main scanning direction. The nozzles of the nozzle row are divided into blocks. The printing apparatus includes a position signal generating unit configured to generate a printing position signal with respect to the main scanning direction, a data generating unit configured to generate printing data, and an enabling signal generating unit configured to generate first enabling signals and second enabling signals based on misalignment information associated with each of the blocks of the nozzle row and the printing position signal generated by the position signal generating unit. The first enabling signals are used to enable the data generating unit to generate printing data on a block-by-block basis. The printing apparatus further includes a drive unit configured to drive the nozzles on a block-by-block basis according to the second enabling signals.

According to a further aspect of the present invention, a method is provided for performing recording with a recording head having at least one recording element row containing a plurality of recording elements arranged in a direction differing from a main scanning direction. The recording elements of the recording element row are divided into a plurality of blocks. The method includes generating a recording position signal with respect to the main scanning direction, and generating recording data. The method also includes generating first enabling signals based on information about inclination of the recording element row and the recording position signal. The first enabling signals are used to enable recording data generation on a block-by-block basis. The method further includes generating second enabling signals and driving the recording elements on a block-by-block basis according the second enabling signals.

Further features of the present invention will become apparent from the following description of exemplary embodiments with reference to the attached drawings.

DESCRIPTION OF THE EMBODIMENTS

Exemplary embodiments of the present invention will now be described in detail with reference to the drawings.

Figure 1:
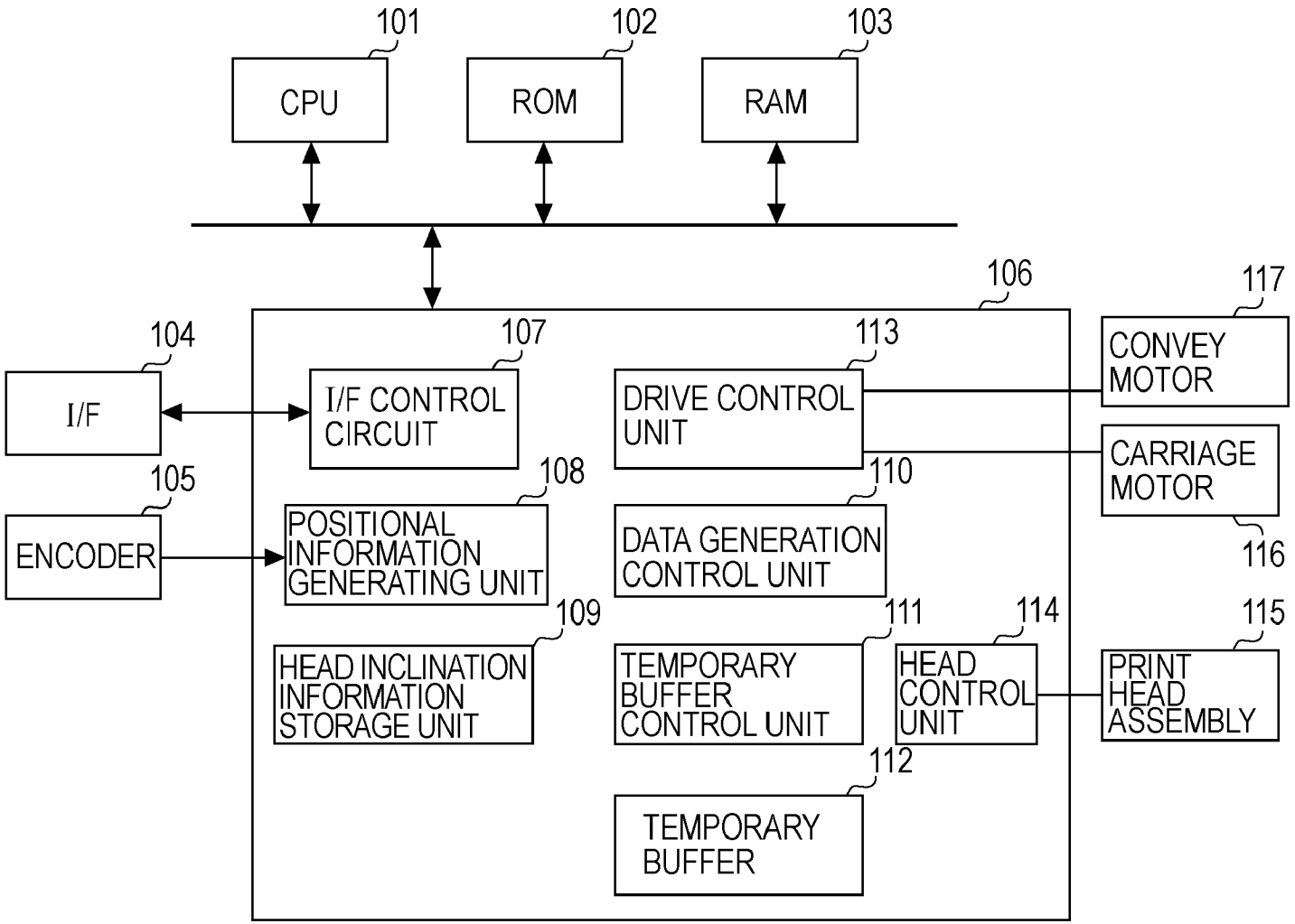
FIG. 1 is a block diagram illustrating an exemplary overall configuration of a recording apparatus according to an embodiment of the present invention.

FIG. 1 is a block diagram illustrating an exemplary overall configuration of a recording apparatus according to an embodiment of the present invention. A control program to be executed by a central processing unit (CPU) 101, table data, and the like are stored in a read-only memory (ROM) 102. A random-access memory (RAM) 103 serves, for example, as a receive buffer for storing data received via an interface 104 from a host apparatus (not shown) and as a print buffer for storing print data. An encoder 105 detects positional information about a carriage. A controller 106 is an application specific integrated circuit (ASIC) controller for the recording apparatus. The controller 106 includes an interface control circuit 107, a positional information generating unit (positional information generator) 108, a head inclination information storage unit 109, and a data generation control unit (data generation controller) 110. The interface control circuit 107 sends and receives data to and from the host apparatus via the interface 104. The positional information generating unit 108 detects positional information about the carriage from the encoder 105 to generate trigger signals for data generation timing and heat timing. Inclination (misalignment) information generated based on the inclination of a print head and required for print control with respect to each nozzle row (nozzle array) is stored in the head inclination information storage unit 109. The data generation control unit 110 generates print data for each nozzle row (nozzle array) in response to data generation timing signals from the positional information generating unit 108. The controller 106 writes print data (recording data) generated in response to a request from the data generation control unit 110 into a temporary buffer 112.

The controller 106 further includes a temporary buffer control unit (temporary buffer controller) 111, a head control unit (head controller) 114, and a drive control unit (motor controller) 113. The temporary buffer control unit 111 reads print data from the temporary buffer 112 in response to a request from the head control unit 114. On the basis of heat timing signals from the positional information generating unit 108, the head control unit 114 transfers actual print data to a print head assembly 115 and controls ink ejection of the print head assembly 115. The drive control unit 113 controls the drive of a carriage motor 116 and a convey motor 117. The carriage motor 116 allows scanning operation of the carriage on which the print head assembly 115 is mounted. The convey motor 117 feeds or ejects recording media.

Next, the print operation of the recording apparatus according to the present exemplary embodiment will be described. Image data or the like received from the host apparatus (not shown) via the interface 104 by the interface control circuit 107 of the controller 106 is temporarily stored in a receive buffer allocated in the RAM 103.

The received data stored in the receive buffer is subjected to command analysis. Actual image data is subjected to print data processing according to the print mode and stored in a print buffer (recording buffer) allocated in the RAM 103. Upon completion of the storage of a required amount of data, the drive control unit 113 drives the carriage motor 116 to start scanning with the recording head (print head).

Figure 8:
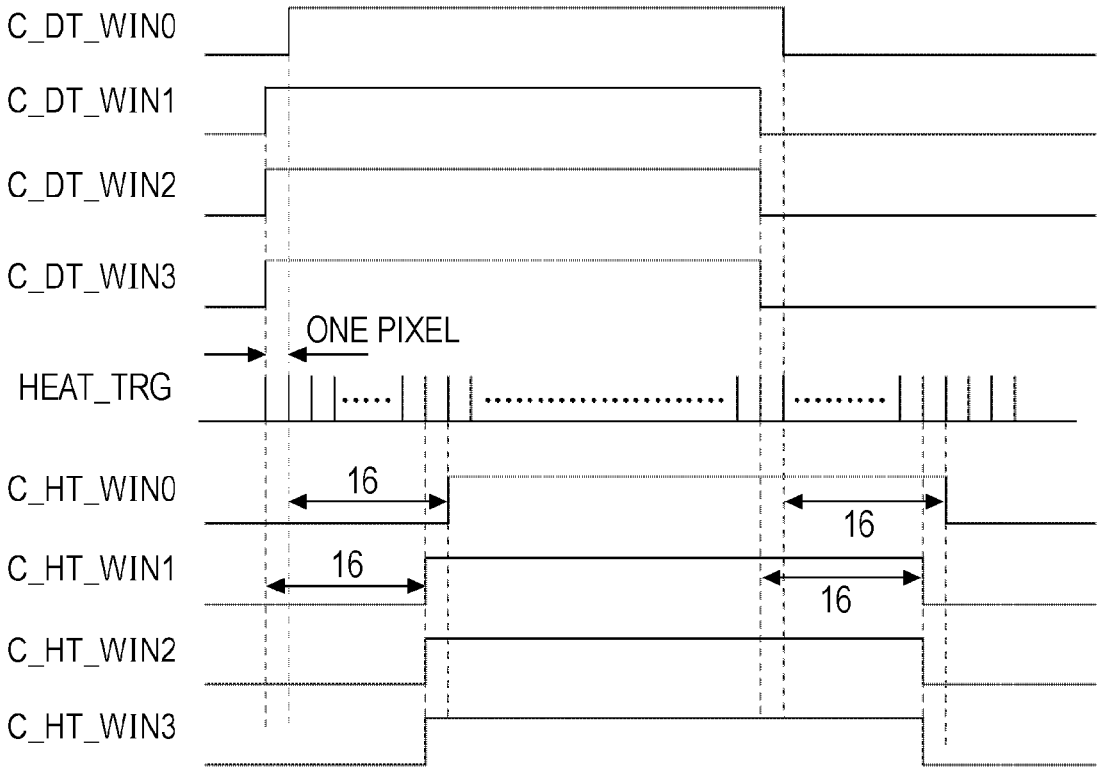
FIG. 8 is a diagram illustrating an example of the relationship between data generation timing and print control timing.

The positional information generating unit 108 detects positional information from the encoder 105 to generate a timing signal (e.g., HEAT_TRG illustrated in FIG. 8). The positional information generating unit 108 outputs a data window signal acting as a data generation timing control signal and a heat window signal acting as a head drive timing signal, according to head inclination information.

The data generation control unit 110 reads image data from the print buffer on the basis of a data window signal, performs predetermined processing (e.g., HV conversion) on the image data, and writes the image data to the temporary buffer 112 through the temporary buffer control unit 111. The HV conversion is such as to convert raster data arranged in a scanning direction (horizontal direction) of the recording head into column data arranged in a nozzle array direction (vertical direction) of the recording head.

On the basis of a heat window signal and at predetermined timing, the head control unit 114 reads actual print data (recording data) held by the temporary buffer control unit 111 to transfer the print data to the print head assembly 115.

Moreover, the head control unit 114 generates a drive signal for the print head assembly 115 and outputs the generated drive signal to the print head assembly 115. The temporary buffer 112 includes two banks, which are toggled between read and write modes. The temporary buffer control unit 111 performs toggle control and address management for the temporary buffer 112.

Upon receipt of the print data and drive signal from the head control unit 114, ink is ejected from the print head assembly 115 to form an image on a recording medium. The drive control unit 113 drives the carriage motor 116 to cause the print head assembly 115 to scan the recording medium. Also, the drive control unit 113 drives the convey motor 117 to cause the recording medium to be transported.

Next, a method for correcting the inclination of a print head to perform printing will be described.

Figure 2:
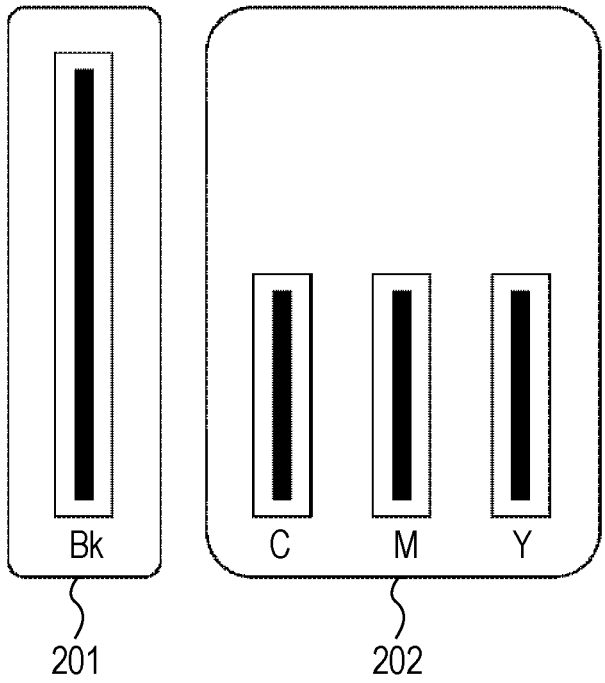
FIG. 2 illustrates an exemplary print head assembly to be mounted on the recording apparatus.

FIG. 2 illustrates an example of the print head assembly 115 (illustrated in FIG. 1) to be mounted on the recording apparatus. The print head assembly illustrated in FIG. 2 includes a plurality of nozzle rows (nozzle array). A print head 201 for black (Bk) ink and a print head 202 for color (cyan (C), magenta (M), and yellow (Y)) ink are configured such that they can be easily attached to or removed from the recording apparatus by the user.

Figure 3:
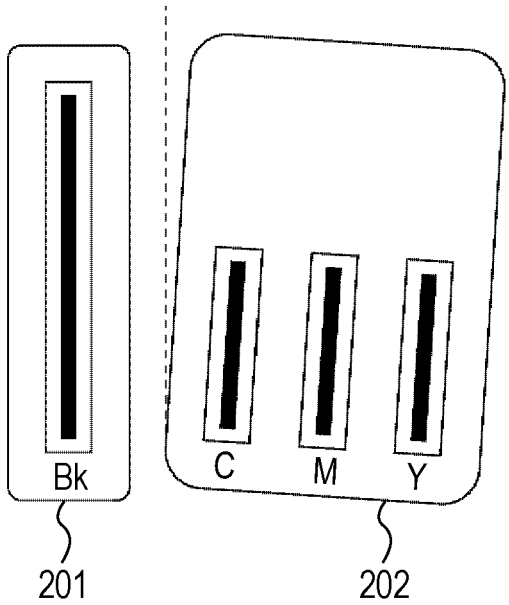
FIG. 3 illustrates an example of the print head assembly mounted on the recording apparatus with a color print head misalignment.
Figure 4A:
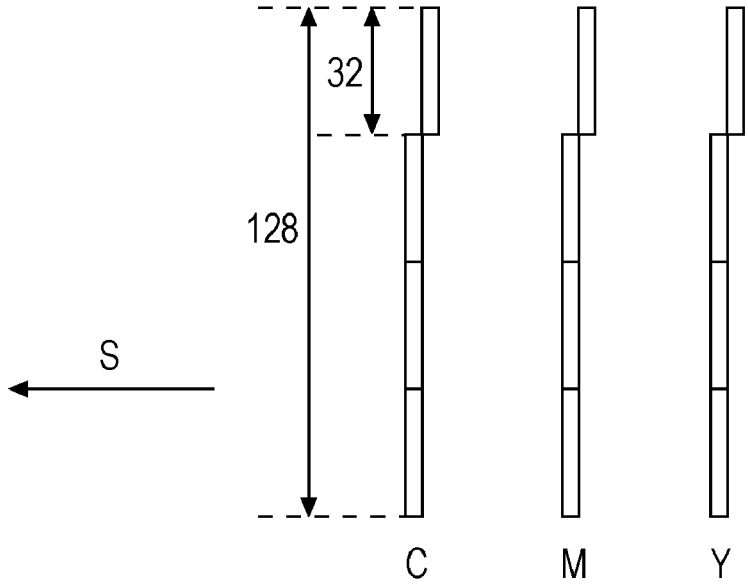
FIG. 4A and FIG. 4B are schematic diagrams illustrating examples of mounted states of the print head assembly in FIG. 3.
Figure 4B:
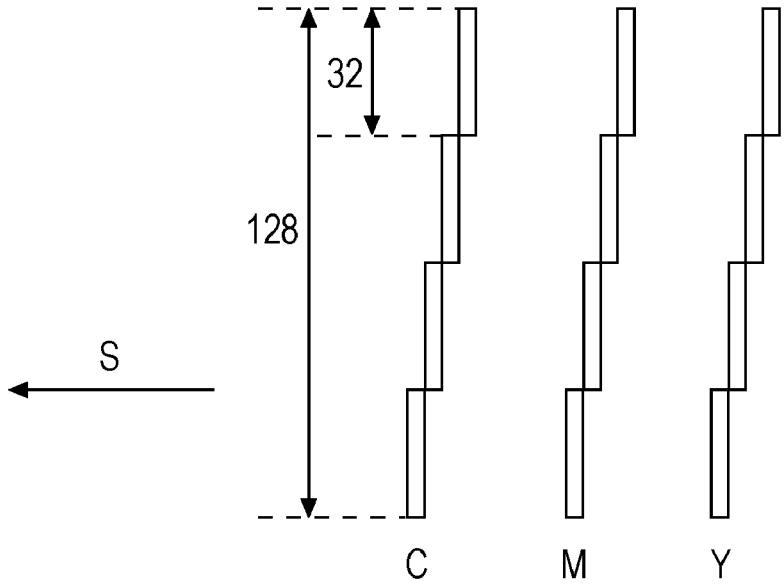

FIG. 4A and FIG. 4B illustrate exemplary simplified models, each representing the print head 202 when mounted on the recording apparatus while being misaligned (inclined) as illustrated in FIG. 3. For ease of explanation, a description will be made with reference to FIG. 4A, in which a group of nozzles in each nozzle row (nozzle array) is shifted by one pixel. Specifically, in a single nozzle row (nozzle array) containing 128 nozzles, the upper 32 nozzles are shifted by one pixel from the lower 96 nozzles. In FIG. 4A and FIG. 4B, "S" denotes a print head scanning direction.

Figure 5:
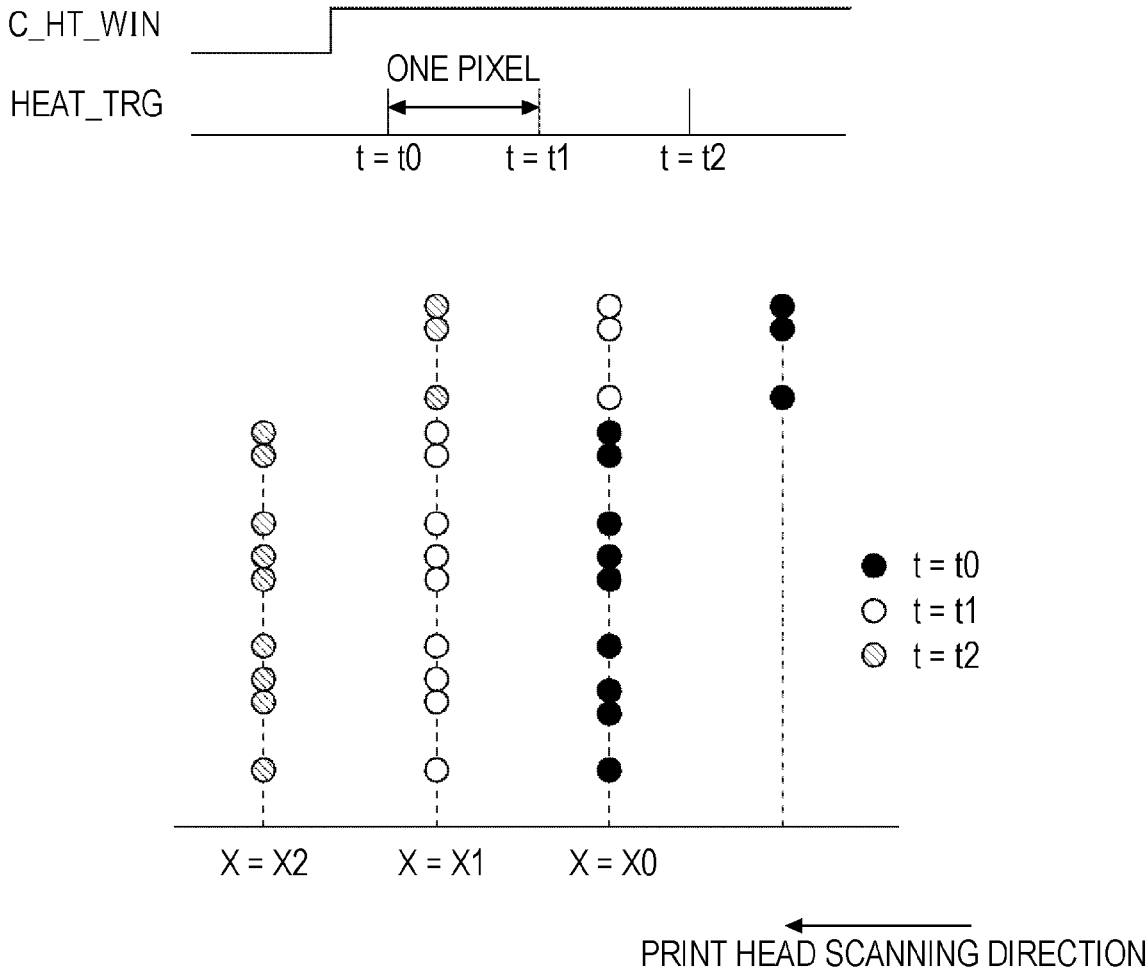
FIG. 5 illustrates an example of drop points of print dots formed with ink ejected from a print head in the state illustrated in FIG. 4A.

FIG. 5 illustrates an example of drop points of print dots formed with ink ejected from the print head 202 in the state illustrated in FIG. 4A. Referring to FIG. 5, C_HT_WIN denotes a heat window signal, which corresponds to a nozzle row (nozzle array) for cyan and enables print head control. HEAT_TRG denotes a trigger signal for data generation and head control. In FIG. 5, signal HEAT_TRG indicates the timing at which, during the scanning of the print head, the print head is driven and ink is ejected therefrom. Signal HEAT_TRG acts as a reference signal for the generation of recording data and the drive of the print head, with respect to the scanning direction of the print head.

In FIG. 5, during the output of signal C_HT_WIN, ink is simultaneously ejected from all nozzles in each nozzle row (nozzle array) at timing t=t0, t1, t2, . . . at which signal HEAT_TRG is output. Therefore, the inclination of the print head causes a misalignment of an image actually formed on a recording medium by one pixel. Specifically, black dots in FIG. 5 are formed by ejecting ink at timing t=t0. Dots from the upper 32 nozzles are dropped upstream of position X=X0 in the print head scanning direction. Dots from the lower 96 nozzles are dropped at position X=X0.

White dots in FIG. 5 are formed by ejecting ink at timing t=t1. Dots from the upper 32 nozzles are dropped at position X=X0, while dots from the lower 96 nozzles are dropped at position X=X1 on paper (recording medium).

In an exemplary embodiment, a nozzle row (nozzle array) is divided into a plurality of blocks (i.e., nozzle groups), each of which is assigned a heat window signal, and heat timing can be shifted on a pixel-by-pixel basis (on a column-by-column basis) based on head inclination information. This control allows the correction of head inclination and an image to be formed on paper.

Figure 6:
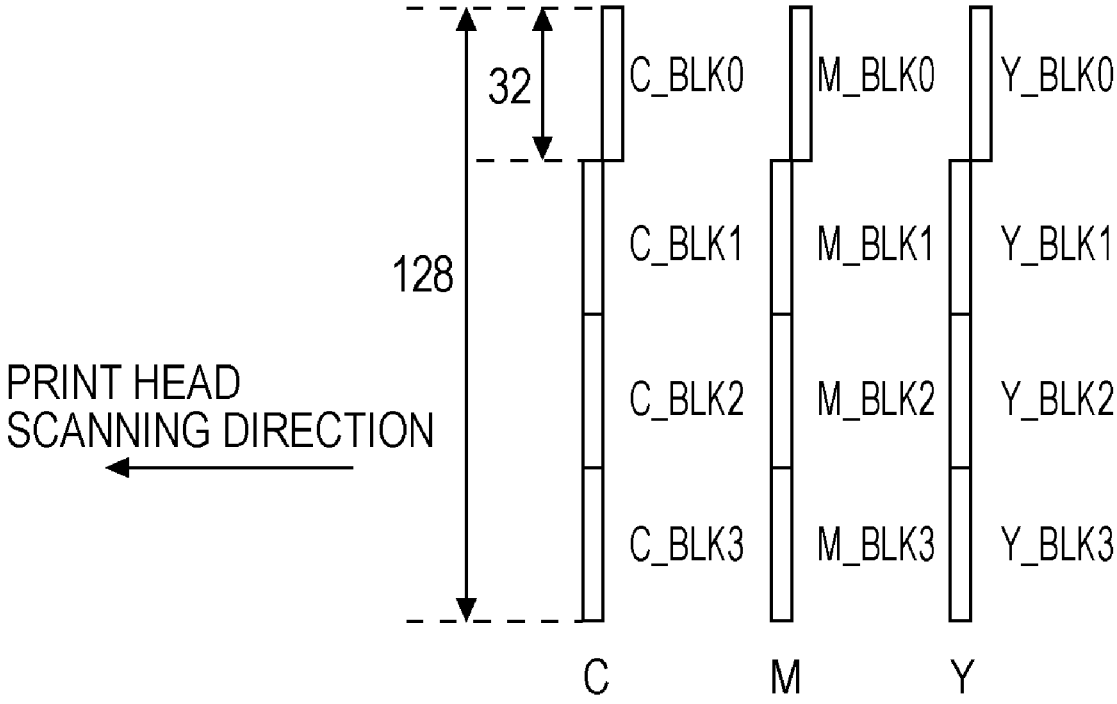
FIG. 6 is a schematic diagram illustrating an example of a mounted state in which each nozzle row (nozzle array) of the print head in FIG. 3 is divided into blocks.

In the present exemplary embodiment, to correct the inclination of nozzle rows (nozzle array) illustrated in FIG. 3, 128 nozzles in a nozzle row (nozzle array) are divided into four blocks, each of which contains 32 nozzles as illustrated in FIG. 6. The upper 32 nozzles corresponding to block C_BLK0 are displaced from the lower 96 nozzles corresponding to blocks C_BLK1 through C_BLK3 by one pixel in the print head scanning direction.

The inclination of nozzle rows (nozzle array) is corrected with reference to block C_BLK0. That is, blocks C_BLK1 through C_BLK3 are adjusted to the position of block C_BLK0.

For example, to move block C_BLK1 in the print head scanning direction ((+) direction, the direction of an arrow in FIG. 6) to be aligned with block C_BLK0, the output timing of a window signal for block C_BLK1 is delayed from the output timing of a window signal (reference signal) for block C_BLK0. Conversely, to move block C_BLK1 in the direction ((−) direction) opposite the print head scanning direction to be aligned with block C_BLK0 (such as in the case of the print head illustrated in FIG. 4A), the output timing of a window signal for block C_BLK1 is advanced from the output timing of a window signal (reference signal) for block C_BLK0. Similar control is performed on blocs C_BLK2 and C_BLK3.

Figure 7:
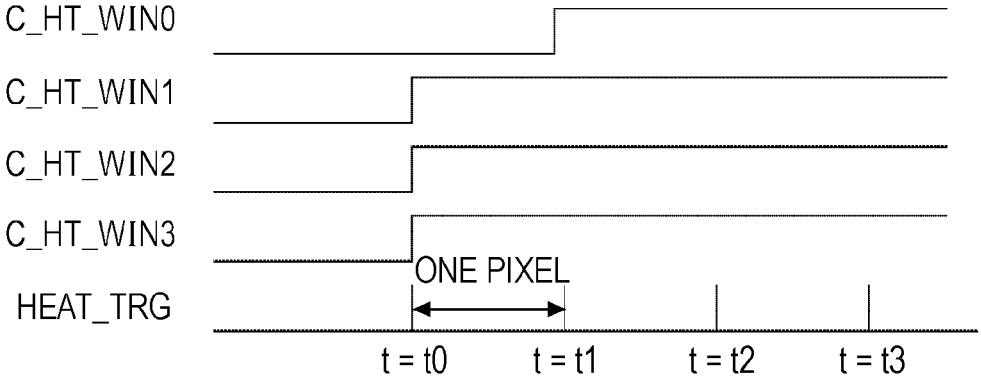
FIG. 7 illustrates an example of drop points of print dots formed with ink ejected from the print head in the state illustrated in FIG. 6.
Figure 7:
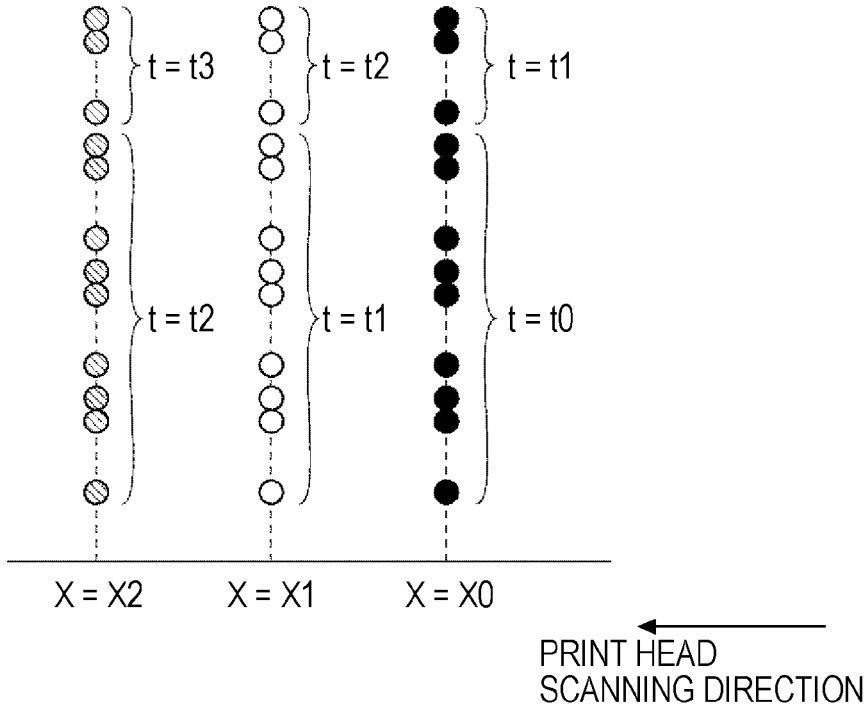

FIG. 7 illustrates an example of drop points of print dots formed with ink ejected from the print head in the state illustrated in FIG. 6. C_HT_WIN0 through C_HT_WIN3 denote heat window signals for respective blocks C_BLK0 through C_BLK3 of the nozzle row (nozzle array) for cyan. The heat window signals are signals that enable ink ejection from the print head. Like signal HEAT_TRG illustrated in FIG. 5, HEAT_TRG denotes a trigger signal on which heat timing is based. That is, signal HEAT_TRG indicates the timing at which, during the scanning of the print head, the print head is driven and ink is ejected therefrom.

Although, in FIG. 6, nozzle rows (nozzle array) for cyan, magenta, and yellow are inclined (misaligned) to the same degree, the degree of inclination can vary. For example, when the upper 32 nozzles in a nozzle row (nozzle array) for magenta are displaced by two pixels from the lower 96 nozzles in the same row, the upper 32 nozzles in a nozzle row (nozzle array) for yellow can be displaced by three pixels from the lower 96 nozzles in the same row.

Figure 11:
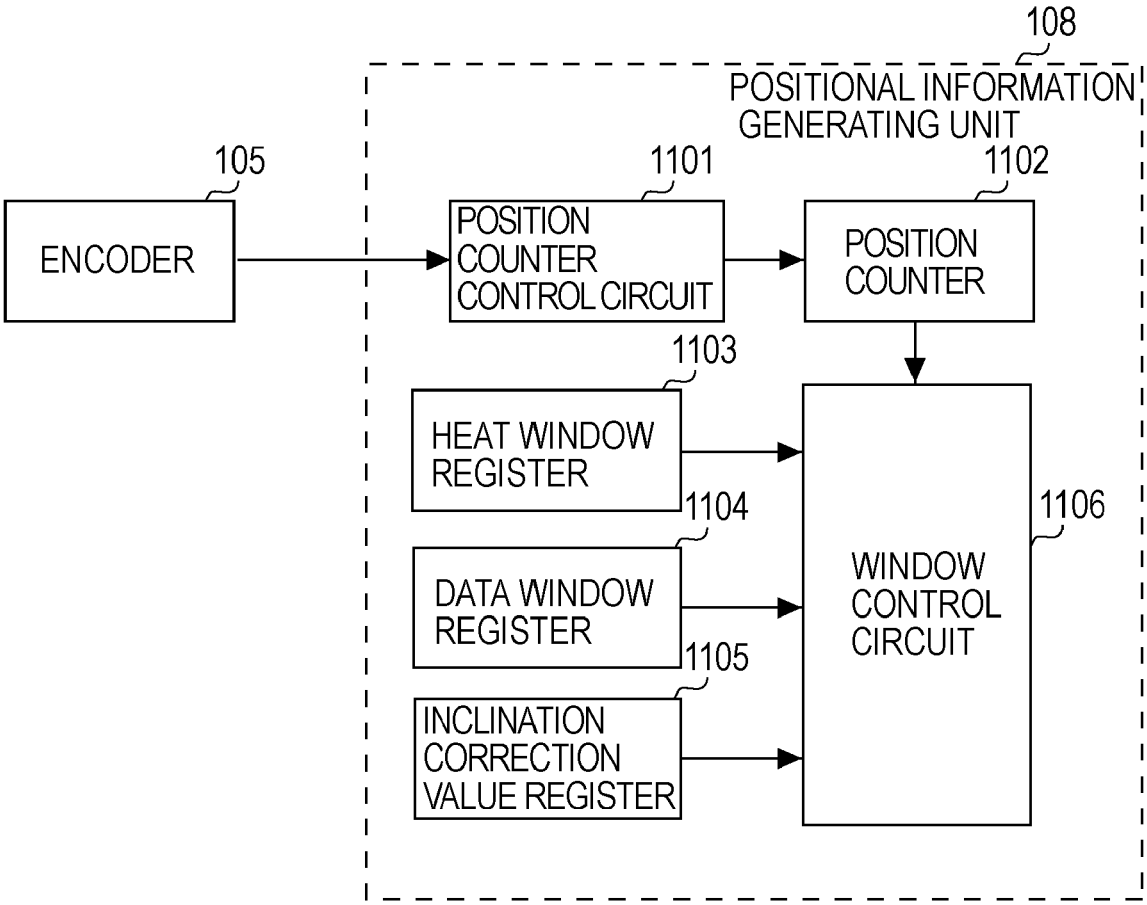
FIG. 11 is a block diagram illustrating a positional information generating unit according to an exemplary embodiment of the present invention.

FIG. 11 is a block diagram illustrating the positional information generating unit 108 according to an exemplary embodiment of the present invention. A position counter control circuit 1101 receives a signal from the encoder 105 to control a position counter 1102. The position counter control circuit 1101 includes a filter circuit for processing signals and a multiplier circuit for multiplying signals from the encoder 105 according to the print mode.

A heat window register 1103 is a register in which positional information that enables a heat window signal for a nozzle row (nozzle array) is set. Positional information that disables the heat window signal is also set in the heat window register 1103. The positional information for enabling or disabling the heat window signal is set with respect to each nozzle row (nozzle array).

A data window register 1104 is a register in which positional information that enables a data window signal for a nozzle row (nozzle array) is set. Positional information that disables the data window signal is also set in the data window register 1104. The positional information for enabling or disabling the data window signal is set with respect to each nozzle row (nozzle array).

An inclination correction value register 1105 is a register in which a correction value for each nozzle row (nozzle array) is set on the basis of head inclination information held in the head inclination information storage unit 109.

A window control circuit 1106 generates a heat window signal and a data window signal on the basis of values in the position counter 1102, heat window register 1103, data window register 1104, and inclination correction value register 1105.

Next, the positional information generating unit 108 described with reference to FIG. 11 will be described in more detail with reference to FIG. 6. In the nozzle row (nozzle array) for cyan in FIG. 6, block C_BLK0 is used as a reference block. Therefore, positions at which a heat window signal for block C_BLK0 is enabled and disabled are set in a cyan section of the heat window register 1103.

For example, settings are configured such that a heat window signal is enabled when the position counter 1102 reaches 1000 h, and is disabled when the position counter 1102 reaches F000 h. The value of the position counter 1102 increases as the print head moves. Blocks C_BLK1 through C_BLK3 are misaligned (inclined), from block C_BLK0 serving as a reference block, toward the print head scanning direction. To bring blocks C_BLK1 through C_BLK3 into alignment with block C_BLK0, blocks C_BLK1 through C_BLK3, which are non-reference blocks, are shifted by one pixel to the (−) direction.

Therefore, in the inclination correction value register 1105, the value "−1" is set in sections corresponding to respective blocks C_BLK1 through C_BLK3. In the position counter 1102, 10 h is equivalent to one pixel.

With this setting, heat window signals C_HT_WIN1 through C_HT_WIN3 are enabled when the position counter 1102 reaches, for example, "0FF0h" during the scanning of the print head. When the print head reaches a position corresponding to, for example, the value "EFF0h" in the position counter 1102, heat window signals C_HT_WIN1 through C_HT_WIN3 are disabled.

Data window signals are controlled on the basis of set values in the data window register 1104 and inclination correction value register 1105, in a similar manner to that in the case of the heat window signals.

Referring to FIG. 7, when the print head starts scanning and a cyan nozzle row (nozzle array) reaches position X=X0, heat window signals for blocks C_BLK1 through C_BLK3 are output at timing t=t0. This allows ink to be ejected from only the lower 96 nozzles to form dots at position X=X0. Since heat window signals for block C_BLK0 are not output, ink is not ejected from the upper 32 nozzles.

Next, when the cyan nozzle row (nozzle array) reaches position X=X1, heat window signals for block C_BLK0 are output at timing t=t1. At this point, ink is ejected from the lower 96 nozzles to form dots at position X=X1. However, since the upper 32 nozzles are displaced by one pixel from the lower 96 nozzles, ink ejected from the upper 32 nozzles forms dots at position X=X0. Likewise, when the cyan nozzle row (nozzle array) reaches position X=X2, heat window signals output at timing t=t2 allow ink to be ejected from the lower 96 nozzles to form dots at position X=X2 and, at the same time, allow ink to be ejected from the upper 32 nozzles to form dots at position X=X1. Thus, shifting the heat timing on a block-by-block basis can correct for the inclination of a nozzle row (nozzle array) and allow the formation of the same image as that formed in the case where the print head is not misaligned.

FIG. 8 illustrates the relationship between data generation timing and print control timing according to the present exemplary embodiment. C_HT_WIN0 through C_HT_WIN3 and HEAT_TRG denote the same signals as those illustrated in FIG. 7. C_DT_WIN0 through C_DT_WIN3 denote data window signals for respective blocks C_BLK0 through C_BLK3 of the nozzle row (nozzle array) for cyan. The data window signals are signals that enable data generation. As illustrated in FIG. 8, the output of a heat window signal starts after a certain delay (e.g., delay time or the amount of delay corresponding to 16 pixels) from the start of the output of a data window signal. Therefore, if the start timing of the output of a data window signal is advanced by one pixel period, the start timing of the output of a heat window signal can also be advanced by one pixel period. Likewise, if the start timing of the output of a data window signal is delayed by one pixel period, the start timing of the output of a heat window signal can also be delayed by one pixel period.

The above-described delay, that is, delay time (or the amount of delay) corresponding to 16 pixels is applicable to the other blocks. Likewise, for each of nozzle rows (nozzle array) for the other colors, the start of the output of a heat window signal is delayed by a 16-pixel period from the start of the output of a data window signal. In an exemplary embodiment, this delay time corresponds to the capacity of a temporally buffer described below.

To advance the start of ink ejection from the lower 96 nozzles corresponding to blocks C_BLK1 through C_BLK3 by one pixel period from the start of ink ejection from the upper 32 nozzles corresponding to block C_BLK0, the positional information generating unit 108 controls data window signals. Specifically, after enabling signals C_DT_WIN1 through C_DT_WIN3 on the basis of head inclination information stored in the head inclination information storage unit 109, the positional information generating unit 108 enables signal C_DT_WIN0 corresponding to the upper 32 nozzles with a delay of one pixel period.

The data generation control unit 110 starts generating data for the lower 96 nozzles in response to trigger signal HEAT_TRG by which three signals C_DT_WIN1 through C_DT_WIN3 are enabled. Likewise, the data generation control unit 110 starts generating data for the upper 32 nozzles in response to trigger signal HEAT_TRG by which signal C_DT_WIN0 is enabled. The temporary buffer 112 of the present exemplary embodiment is provided for each nozzle row (nozzle array) and includes two banks, each bank having a capacity that can hold data corresponding to 16 columns (16 pixels in the main scanning direction). In other words, each nozzle row (nozzle array) is provided with the temporary buffer 112 including two banks.

The data generation control unit 110 generates data for 16 columns with respect to each of the blocks corresponding to respective signals C_DT_WIN0 through C_DT_WIN3 and completes the generation of data every time the generation of data for 16 columns is completed. Then, the data generation control unit 110 writes print data through the temporary buffer control unit 111 to the temporary buffer 112. Print data for 16 columns is written each time to one of bank 0 and bank 1 of the temporary buffer 112. A buffer to which the print data is written is toggled between bank 0 and bank 1.

After enabling data window signals C_DT_WIN0 through C_DT_WIN3, the positional information generating unit 108 enables heat window signals C_HT_WIN0 through C_HT_WIN3, each of which is delayed by 16-column period from their corresponding data window signals. On the basis of these heat window signals, the head control unit 114 reads print data held in the temporary buffer 112, transfers the print data to the print head assembly 115 at predetermined timing, and generates and outputs an actual drive signal for the print head assembly 115. Print data for 16 columns is read each time from one of bank 0 and bank 1 of the temporary buffer 112. A buffer from which the print data is read is toggled between bank 0 and bank 1. In other words, print data is read from bank 0 while being written to bank 1, and is read from bank 1 while being written to bank 0.

Figure 9A:
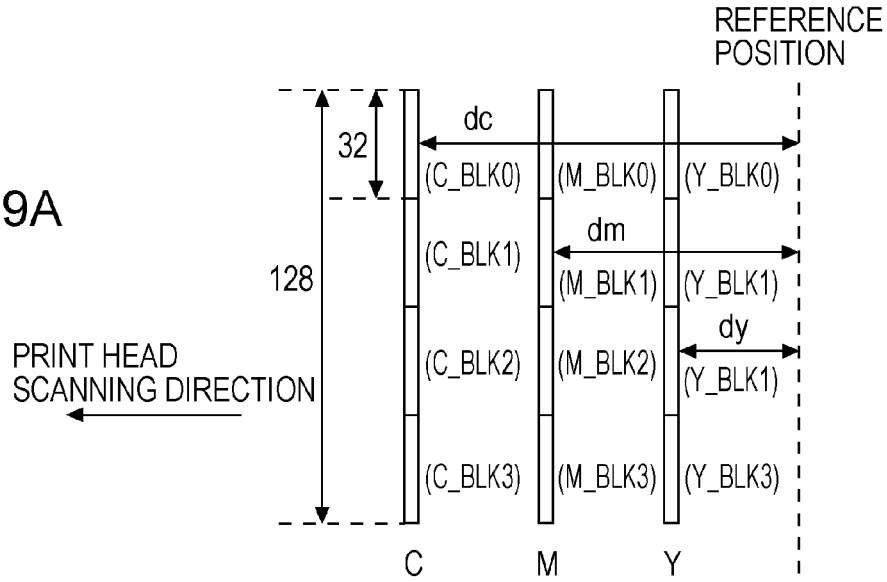
FIG. 9A is a schematic diagram illustrating an example of variations in distance between nozzle rows.
Figure 9B:
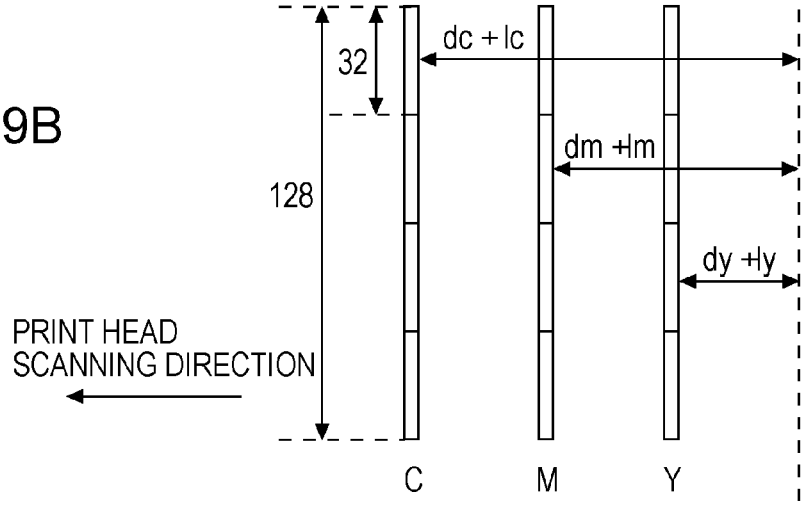
FIG. 9B is a schematic diagram illustrating an example of the nozzle rows in FIG. 9A after intervals between the nozzles rows have been corrected.

Next, timing adjustment between nozzle rows (nozzle array) will be described with reference to FIG. 9A through FIG. 9C. FIG. 9A illustrates a state in which the print head 202 for color ink is not misaligned. The distances from a predetermined reference position to nozzle rows (nozzle array) for cyan, magenta, and yellow are indicated by "dc", "dm", and "dy", respectively.

FIG. 9A illustrates an example of variations in distance between nozzle rows (nozzle array) vary due to individual dimensional variations that can occur in the manufacturing process. The variations in distance between nozzle rows (nozzle array) can cause color misalignment in an image recorded on a recording medium. Therefore, as illustrated in FIG. 9B, intervals between nozzle rows (nozzle array) are corrected by performing registration between nozzle rows (nozzle array). Specifically, if the distances from the reference position to the nozzle rows (nozzle array) for cyan, magenta, and yellow are consistently "dc+lc", "dm+lm", and "dy+ly", respectively, an image can be formed without color misalignment.

Moreover, in view of the inclination of the print head, window signals are controlled on a block-by-block basis. For example, FIG. 9C illustrates a state where the upper 32 nozzles in each nozzle row (nozzle array) are displaced from the lower 96 nozzles. In this case, where correction values obtained by head inclination information are "pc", "pm", and "py", the distance from the reference position to cyan block C_BLK0 is expressed as "dc+lc+pc", while the distance from the reference position to cyan blocks C_BLK1 through C_BLK3 is expressed as "dc+lc"; the distance from the reference position to magenta block M_BLK0 is expressed as "dm+lm+pm", while the distance from the reference position to magenta blocks M_BLK1 through M_BLK3 is expressed as "dm+lm"; and the distance from the reference position to yellow block Y_BLK0 is expressed as "dy+ly+py", while the distance from the reference position to yellow blocks Y_BLK1 through Y_BLK3 is expressed as "dy+ly".

Figure 9C:
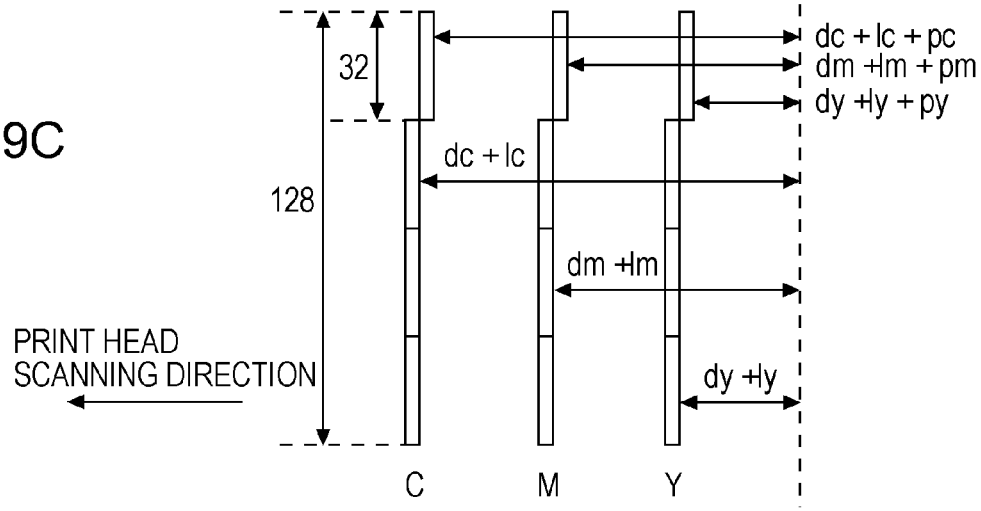
FIG. 9C is a schematic diagram illustrating an example of nozzle rows in which the upper 32 nozzles are displaced from the lower 96 nozzles.
Figure 10:
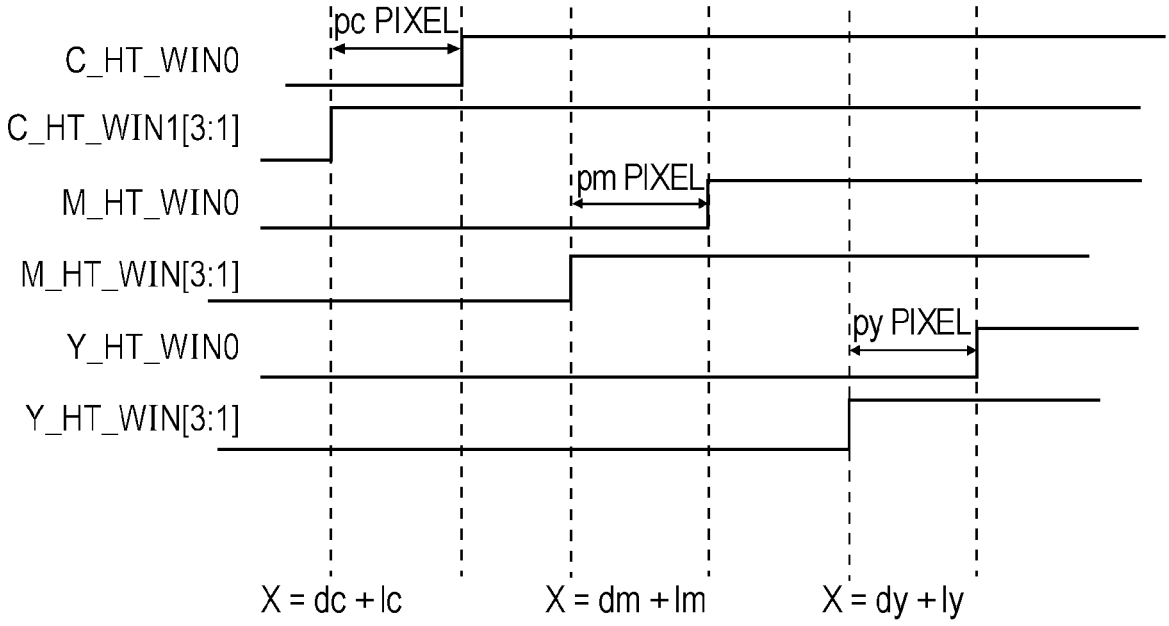
FIG. 10 is a diagram illustrating an example of heat timing for respective nozzle blocks in FIG. 9C.

FIG. 10 illustrates heat window signals for respective blocks in FIG. 9C according to an exemplary embodiment of the present invention. Each heat window signal is enabled when its corresponding block has reached a predetermined position. Therefore, when the nozzle row (nozzle array) for cyan moves in the main scanning direction and reaches a distance of "dc+lc" from the reference position, signals C_HT_WIN1 through C_HT_WIN3 are enabled. Subsequently, when the print head moves a "pc" pixel distance to reach a distance of "dc+lc+pc" from the reference position, a signal C_HT_WIN0 is enabled.

Likewise, when the nozzle row (nozzle array) for magenta reaches a distance of "dm+lm" from the reference position, signals M_HT_WIN1 through M_HT_WIN3 are enabled. Subsequently, when the print head moves a "pm" pixel distance to reach a distance of "dm+lm+pm" from the reference position, a signal M_HT_WIN0 is enabled.

Likewise, when the nozzle row (nozzle array) for yellow reaches a distance of "dy+ly" from the reference position, signals Y_HT_WIN1 through Y_HT_WIN3 are enabled. Subsequently, when the print head moves a "py" pixel distance to reach a distance of "dy+ly+py" from the reference position, a signal Y_HT_WIN0 is enabled.

A data window signal assigned to each block is enabled a 16-pixel period (distance) before its corresponding heat window signal is enabled.

Thus, the positional information generating unit 108 controls data window signals and heat window signals on the basis of information about registration between nozzle rows (nozzle array) and head inclination information stored in the head inclination information storage unit 109.

As described above, data window signals C_DT_WIN0 through C_DT_WIN3 for data generation control and heat window signals C_HT_WIN0 through C_HT_WIN3 are always controlled in synchronization with each other. Performing this control allows a print operation to be performed while print data for 16 columns is being held in the temporary buffer 112.

Figure 12:
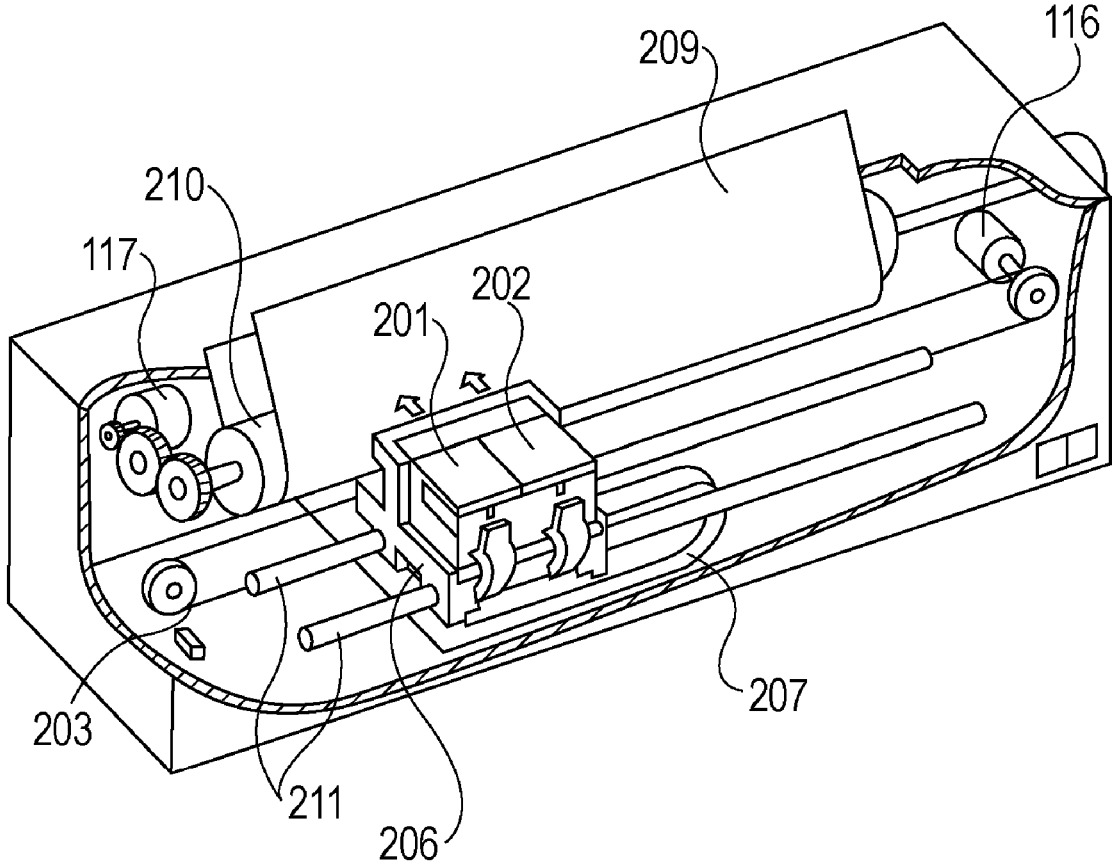
FIG. 12 is a perspective view illustrating the recording apparatus according to an exemplary embodiment of the present invention.

FIG. 12 is a perspective view illustrating the recording apparatus (printer) according to an exemplary embodiment of the present invention. The print heads 201 and 202 are mounted on a carriage 206 and can reciprocate along the length of shafts 211.

Ink is ejected from the print heads 201 and 202 onto a recording medium 209 that is controlled on its recording surface by a platen roller 210, with a very small clearance left between the recording medium 209 and the print heads 201 and 202. An image is thus formed on the recording medium 209.

In response to image data, ejection signals are supplied to the print heads 201 and 202 through a flexible cable 207. The carriage motor 116 causes the carriage 206 to scan the recording medium 209 along the shafts 211. The drive force of the carriage motor 116 is transmitted through a wire 203 to the carriage 206. The convey motor 117 is combined with the platen roller 210 to transport the recording medium 209.

With the configuration described above, the data generation and print timing of each block of a nozzle row (nozzle array) can be adjusted on the basis of head inclination information, on a pixel-by-pixel basis. This allows an image to be formed without having to store, in a print buffer, data corresponding to the inclination of a print head. This can eliminate the load of storing, in the print buffer, data that reflects the inclination of a nozzle row (nozzle array).

Moreover, synchronizing a data window signal and a heat window signal can prevent the unnecessary drive of a print head that occurs due to noise, and thus can prevent unnecessary ink ejection.

Although a single bank of the temporary buffer 112 has a capacity of 16 columns of data in the explanation described above, the capacity of a single bank is not limited to this. For example, if a single bank of the temporary buffer 112 has a capacity of 8 columns of data, the start of the output of a heat window signal can be controlled to be delayed by an 8-pixel period.

If the capacity of a single bank of the temporary buffer 112 is further changed, a heat window signal can be controlled such that its output timing is varied according to the changed capacity.

The capacity of a single bank of the temporary buffer 112 is changed when the amount of data generated per unit time is changed, or when a memory area in the temporary buffer 112 is partially used for other purposes. Therefore, the output timing of a heat window signal is controlled such that it is changed on the basis of the settings of an allocating unit that performs area allocation in the temporary buffer 112.

In other words, the capacity of a single bank of the temporary buffer 112 is changed when a print mode or the type of a print head to be used is changed.

The type of a print head is changed when various print heads with various numbers of nozzle row (nozzle array) or for various numbers of colors can be mounted on the recording apparatus, and when the user changes the print head. In this case, the recording apparatus includes an identifying unit that can identify the type of a print head mounted on the recording apparatus.

In the present exemplary embodiment, head inclination correction is performed on a pixel-by-pixel basis. This means that the resolution of the head inclination correction (in the scanning direction of the print head) is equal to the print resolution. That is, if the print resolution is 1200 dpi, the head inclination correction is performed at a resolution of 1200 dpi.

The inclination of a print head that occurs during the assembly process of the print head corresponds to several (an integral number of) dots at a resolution of 1200 dpi. In this case, in a print mode where printing is performed at a resolution of 1200 dpi, the head inclination correction is reflected on the resulting image. However, in draft mode (high speed mode) where printing is performed at a resolution of 300 dpi, there is no need to perform correction, as the resolution of head inclination correction is also 300 dpi.

Therefore, head inclination correction can be controlled not to be performed depending on the print mode. In other words, it can be configured such that the positional information generating unit 108 performs control on the basis of information about the print mode.

Although the position counter 1102 is set on a pixel-by-pixel basis in the present exemplary embodiment described above, the position counter 1102 can be set in steps of less than one pixel for higher precision in adjustment. For example, the position counter 1102 can be set in steps of 0.5 pixels. Here, an adjustment value for 0.5 pixels is 08 h.

An exemplary method for obtaining head inclination information is to determine a correction value on the basis of a registration pattern that is output in a certain mode of the recording apparatus. In another exemplary method, the recording apparatus receives head inclination information prestored in a storage unit of a recording head mounted on the recording apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-188291 filed Jun. 28, 2005, which is hereby incorporated by reference herein in its entirety.

What is claimed is:

1. A recording apparatus that performs recording with a recording head having at least one recording element row containing a plurality of recording elements arranged in a direction differing from a main scanning direction, the recording elements of the recording element row being divided into a plurality of blocks, the recording apparatus comprising:

a position signal generating unit configured to generate a recording position signal with respect to the main scanning direction;

a data generating unit configured to generate recording data;

an enabling signal generating unit configured to generate, based on information about inclination of the recording element row and the recording position signal generated by the position signal generating unit, a plurality of first enabling signals that enable the data generating unit to generate recording data on a block-by-block basis in the main scanning direction, and a plurality of second enabling signals that correspond to the respective first enabling signals delayed by a time interval and enable the recording elements to be driven on a block-by-block basis; and a drive unit configured to drive the recording elements on a block-by-block basis according to the second enabling signals.

2. The recording apparatus according to claim 1, further comprising a memory unit configured to store the information about inclination of the recording element row.

3. The recording apparatus according to claim 1, wherein the recording head includes a plurality of recording element rows in the main scanning direction, and the enabling signal generating unit generates the first enabling signals on the basis of information about the arrangement of each recording element row in the recording head.

4. The recording apparatus according to claim 1, further comprising a buffer to store recording data read from a print buffer to be transferred to the recording head, wherein the time interval is selected based on the number of columns of recording data stored in the buffer.

5. The recording apparatus according to claim 4, wherein recording data is stored in the buffer in units of "n" columns.

6. The recording apparatus according to claim 5, further comprising a converting unit configured to perform HV conversion on data read from the print buffer, before the data is stored in the buffer.

7. The recording apparatus according to claim 1, wherein the enabling signal generating unit changes the time interval according to a recording mode selected from a plurality of recording modes provided by the recording apparatus.

8. The recording apparatus according to claim 4, wherein the enabling signal generating unit changes the time interval on the basis of allocation in the buffer.

9. A printing apparatus that performs printing with a print head having at least one nozzle row containing a plurality of nozzles arranged in a direction differing from a main scanning direction, the nozzles being divided into blocks, the printing apparatus comprising:

a position signal generating unit configured to generate a printing position signal with respect to the main scanning direction;

a data generating unit configured to generate printing data;

an enabling signal generating unit configured to generate first enabling signals and second enabling signals based on misalignment information associated with each of the blocks of the nozzle row and the printing position signal generated by the position signal generating unit, the first enabling signals to enable the data generating unit to generate printing data on a block-by-block basis, and the second enabling signals to enable the nozzles to be driven on a block-by-block basis; and a drive unit configured to drive the nozzles on a block-by-block basis according to the second enabling signals.

10. The printing apparatus according to claim 9, wherein the second enabling signals correspond to the respective first enabling signals delayed by a time interval.

11. The printing apparatus according to claim 10, further comprising:

a control unit configured to selectively change the time interval.

12. The printing apparatus according to claim 11, wherein the time interval is selected according to a printing mode selected from a plurality of printing modes.

13. A method for performing recording with a recording head having at least one recording element row containing a plurality of recording elements arranged in a direction differing from a main scanning direction, the recording elements of the recording element row being divided into a plurality of blocks, the method comprising:

generating a recording position signal with respect to the main scanning direction;

generating recording data;

generating, based on information about inclination of the recording element row and the recording position signal, a plurality of first enabling signals that enable recording data generation on a block-by-block basis;

generating a plurality of second enabling signals that enable the recording elements to be driven on a block-by-block basis; and driving the recording elements on a block-by-block basis according to the second enabling signals.

14. The method according to claim 13, wherein the second enabling signals are generated corresponding to the respective first enabling signals delayed by a time interval.

15. The method according to claim 13, further comprising:

storing the information about inclination of the recording element row.

16. The method according to claim 14, wherein the recording head includes a plurality of recording element rows in the main scanning direction; and wherein the first enabling signals are generated based on information about an arrangement of each recording element row in the recording head.

17. The method according to claim 14, further comprising:

using a buffer to store recording data read from a print buffer to be transferred to the recording head; and selecting the time interval based on a number of columns of recording data stored in the buffer.

18. The method according to claim 14, further comprising:

changing the time interval according to a recording mode selected from a plurality of recording modes.

19. The method according to claim 16, further comprising:

changing the time interval based on allocation of the recording data in the buffer.

* * * * *